US008021995B2

(12) United States Patent
Suzuki et al.

(10) Patent No.: US 8,021,995 B2
(45) Date of Patent: Sep. 20, 2011

(54) MIXED FIBER AND STRETCH NONWOVEN FABRIC COMPRISING SAID MIXED FIBER AND METHOD FOR MANUFACTURE THEREOF

(75) Inventors: Kenichi Suzuki, Sodegaura (JP); Shigeyuki Motomura, Sodegaura (JP); Satoshi Yamasaki, Sodegaura (JP); Daisuke Nishiguchi, Sodegaura (JP); Hisashi Kawanabe, Sodegaura (JP)

(73) Assignee: Mitsui Chemicals, Inc., Minato-ku, Tokyo (JP)

( * ) Notice: Subject to any disclaimer, the term of this patent is extended or adjusted under 35 U.S.C. 154(b) by 156 days.

(21) Appl. No.: 10/543,324

(22) PCT Filed: Jan. 23, 2004

(86) PCT No.: PCT/JP2004/000573

§ 371 (c)(1),
(2), (4) Date: Jul. 22, 2005

(87) PCT Pub. No.: WO2004/065680

PCT Pub. Date: Aug. 5, 2004

(65) Prior Publication Data

US 2006/0121812 A1 Jun. 8, 2006

(30) Foreign Application Priority Data

Jan. 24, 2003 (JP) ..... 2003-016802
Jan. 24, 2003 (JP) ..... 2003-016803

(51) Int. Cl.
*D04H 3/16* (2006.01)

(52) U.S. Cl. ..... 442/329; 442/328; 442/401; 442/411; 442/415; 156/167

(58) Field of Classification Search ..... 156/167; 442/328, 329, 401, 411, 415
See application file for complete search history.

(56) References Cited

U.S. PATENT DOCUMENTS

| | | | | |
|---|---|---|---|---|
| 4,209,563 | A | 6/1980 | Sisson | |
| 5,391,682 | A * | 2/1995 | Ogawa et al. | 528/59 |
| 5,621,024 | A * | 4/1997 | Eberhardt et al. | 523/324 |
| 6,429,159 | B1 * | 8/2002 | Watanabe et al. | 442/329 |

FOREIGN PATENT DOCUMENTS

EP 0125494 A2 11/1984

(Continued)

OTHER PUBLICATIONS

International Search Report for PCT/JP2004/000573 dated May 11, 2004.

(Continued)

*Primary Examiner* — Elizabeth Cole
(74) *Attorney, Agent, or Firm* — Rankin, Hill & Clark LLP

(57) ABSTRACT

A fiber mixture according to the invention comprises fibers A comprising a polymer A containing a thermoplastic polyurethane elastomer and fibers B comprising a thermoplastic polymer B other than the thermoplastic polyurethane elastomer, said thermoplastic polyurethane elastomer having a starting temperature for solidifying of 65° C. or above as measured by a differential scanning calorimeter (DSC) and containing $3.00\times10^6$ or less polar-solvent-insoluble particles per g counted on a particle size distribution analyzer, which is based on an electrical sensing zone method, equipped with an aperture tube having an orifice of 100 μm in diameter. An elastic nonwoven fabric comprises the fiber mixture.

23 Claims, 2 Drawing Sheets

FOREIGN PATENT DOCUMENTS

| | | | | |
|---|---|---|---|---|
| EP | 1043438 | A1 | | 10/2000 |
| JP | 47-038914 | | | 10/1972 |
| JP | 04277513 | | * | 10/1992 |
| JP | 06192368 | | * | 7/1994 |
| JP | 09-087358 | | | 3/1997 |
| JP | 09087358 | A | * | 3/1997 |
| JP | 09-291454 | | | 11/1997 |
| JP | 2002-522653 | | | 7/2002 |
| JP | 2002-242069 | | | 8/2002 |
| JP | 14242069 | A | * | 8/2002 |
| WO | WO 9315251 | | * | 8/1993 |
| WO | WO 99/39037 | A1 | | 8/1999 |
| WO | WO 00/08243 | A1 | | 2/2000 |
| WO | 03040452 | | | 5/2003 |

OTHER PUBLICATIONS

European Search Report for European Application No. 04704736.0 dated Dec. 9, 2008 corresponding to U.S. Appl. No. 10/543,324, filed Jul. 22, 2005.

* cited by examiner

MIXED FIBER AND STRETCH NONWOVEN FABRIC COMPRISING SAID MIXED FIBER AND METHOD FOR MANUFACTURE THEREOF

FIELD OF THE INVENTION

The present invention relates to a fiber mixture containing fibers A that comprise a polymer containing a thermoplastic polyurethane elastomer and fibers B that comprise another different thermoplastic polymer. The invention also relates to an elastic nonwoven fabric comprising the fiber mixture and a production method for the nonwoven fabric. Moreover, the invention relates to a laminate and a hygiene material that include the elastic nonwoven fabric.

BACKGROUND OF THE INVENTION

Elastic nonwoven fabrics made from thermoplastic polyurethane elastomers (hereinafter "TPU") proposed so far have been used in applications including garments, hygiene materials and materials for sporting goods due to their high elasticity, low residual strain and superior breathability.

JP-A-2002-522653 addresses the characteristic "sticky" nature of the thermoplastic elastomers as one of the problems encountered in spunbonding the elastomers into nonwoven fabrics. It has been pointed out that turbulence in the air can bring filaments into contact and they can adhere to one another in the spunbonding. The "stickiness" has been proven to be especially troublesome during rolling up of the webs. Further, JP-A-2002-522653 mentions breakage and elastic failure of the strand during extrusion and/or stretching.

These problems are solved by a strand that comprises at least two polymers, one is more elastic than the other, with the less elastic polymer constituting at least a portion of the peripheral surface of the strand. Specifically, Example 10 of JP-A-2002-522653 demonstrates production of a spunbonded web using TPU to constitute the core of filament and a liner low-density polyethylene (hereinafter "LLDPE") to constitute the sheath. It is read, "the bonded web became manageable and could be wound up and subsequently unwound". However, if fibers become thin in the above production, filament breaking occurs so that attempts to obtain nonwoven fabrics having desired fiber diameters will fail.

JP-A-9-291454 discloses elastic nonwoven fabrics, having excellent drape, comprising a conjugate fiber comprising a crystalline polypropylene and a thermoplastic elastomer. It discloses an elastic nonwoven fabric which comprises a concentric sheath-core conjugate fiber made up of 50 wt % of a urethane elastomer as the core and 50 wt % of a polypropylene as the sheath (Example 6). The disclosure extends to an elastic nonwoven fabric which comprises a conjugate fiber made up of 50 wt % of a urethane elastomer and 50 wt % of a polypropylene to show a six-segmented cross section (Example 8). These nonwoven fabrics are capable of about 75% elastic recovery after 20% elongation and have excellent drape. However, they are still insufficient in elastic properties for applications such as garments, hygiene materials and materials for sporting goods.

JP-A-2002-242069 discloses nonwoven fabrics comprising a mixture of two kinds of fibers made from two different polymers. It is described that such nonwoven fabrics have superior touch and elastic properties attributed to combined characteristics of the different materials. However, it does not provide a specific disclosure on polyurethane elastomers. As Comparative Example 4 in this specification will illustrate, inferior elastic properties, rough touch and in addition bad spinnability are encountered even when the nonwoven fabrics are produced from a fiber mixture containing a polyurethane elastomer fiber and a polypropylene fiber.

OBJECT OF THE INVENTION

The invention is aimed at solving the aforesaid problems associated with the background art. Thus, it is an object of the invention to provide a beautifully spun fiber mixture, and an elastic nonwoven fabric from the fiber mixture that is superior in touch, heat sealing properties, productivity and elasticity, and that has low residual strain. It is another object to provide a laminate and a hygiene material including the elastic nonwoven fabric. It is a further object of the invention to provide a production method for the elastic nonwoven fabric by a spunbonding technique.

DISCLOSURE OF THE INVENTION

The present inventors earnestly studied to overcome the aforesaid problems, and completed the present invention based on the finding that the use of a thermoplastic polyurethane elastomer having a specific starting temperature for solidifying and a specific content of polar-solvent insolubles can solve the "stickiness"-related problems, such as bad spinnability (formability) and filament breakage, and it also leads to a nonwoven fabric displaying excellent touch and high elasticity.

A fiber mixture according to the invention comprises fibers A comprising a polymer A containing a thermoplastic polyurethane elastomer and fibers B comprising a thermoplastic polymer B other than the thermoplastic polyurethane elastomer, said thermoplastic polyurethane elastomer having a starting temperature for solidifying of 65° C. or above as measured by a differential scanning calorimeter (DSC) and containing $3.00\times10^6$ or less polar-solvent-insoluble particles per g counted on a particle size distribution analyzer, which is based on an electrical sensing zone method, equipped with an aperture tube having an orifice of 100 μm in diameter.

The fiber B preferably is an inelastic fiber.

The polymer A preferably contains the thermoplastic polyurethane elastomer in an amount of 50 wt % or more.

On the thermoplastic polyurethane elastomer, a total heat of fusion (a) determined from endothermic peaks within the temperature range of from 90 to 140° C. and a total heat of fusion (b) determined from endothermic peaks within the temperature range of from above 140 to 220° C., which are measured by a differential scanning calorimeter (DSC), preferably satisfy the following relation (1):

$$a/(a+b)\times100\leqq80 \quad (1)$$

An elastic nonwoven fabric according to the invention is obtained by depositing the fiber mixture into the form of a web, partially fusion bonding the deposit and stretching the partially fusion bonded web.

A laminate according to the invention contains at least one layer comprising the elastic nonwoven fabric. A hygiene material of the invention comprises the elastic nonwoven fabric.

A production method for elastic nonwoven fabrics according to the invention comprises the acts (steps) of:

(I) separately melting a polymer A containing a thermoplastic polyurethane elastomer and a thermoplastic polymer B other than the thermoplastic polyurethane elastomer, said thermoplastic polyurethane elastomer having a starting temperature for solidifying of 65° C. or above as measured by a differential scanning calorimeter (DSC) and containing $3.00\times10^6$ or less polar-solvent-insoluble particles per g counted on a particle size distribution analyzer, which is based on an electrical sensing zone method, equipped with an aperture tube having an orifice of 100 μm in diameter;

(II) extruding the polymer A and the polymer B simultaneously through a die having respective nozzles for the polymers to spin them and depositing fibers into the form of a web of fiber mixture;

(III) partially fusion bonding the web; and (IV) stretching the partially fusion bonded web.

EFFECT OF THE INVENTION

The fiber mixture is beautifully spun. The elastic nonwoven fabric has excellent touch, heat sealing properties and productivity, and low residual strain as well as high elasticity. The laminate and hygiene material according to the invention each have a layer comprising the elastic nonwoven fabric and other layer(s), these layers being bonded together with good adhesion, particularly due to the heat sealing.

PREFERRED EMBODIMENTS OF THE INVENTION

<Fiber Mixture and Elastic Nonwoven Fabric>

Figure 1:
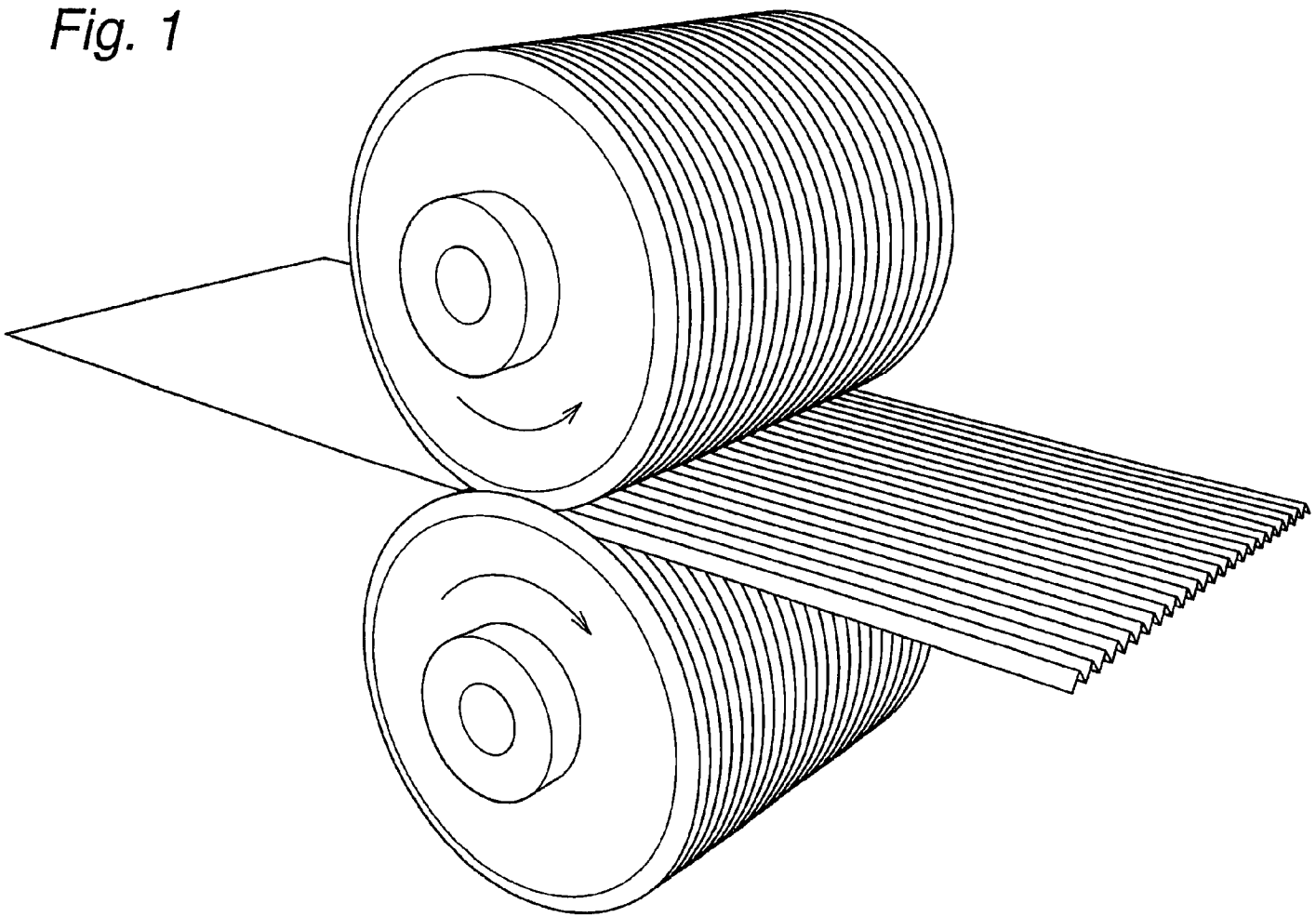
FIG. 1 is a schematic view of stretching gears.

The fiber mixture of the invention contains fibers A which comprise a polymer A containing a thermoplastic polyurethane elastomer with a specific starting temperature for solidifying and a specific content of polar-solvent insolubles, and fibers B which comprise a thermoplastic polymer B other than the thermoplastic polyurethane elastomer.

The elastic nonwoven fabric can be obtained by depositing the fiber mixture into the form of a web, then partially fusion bonding the deposit, and stretching the partially fusion bonded web.

<Thermoplastic Polyurethane Elastomer>

The thermoplastic polyurethane elastomer (TPU) has a starting temperature for solidifying of 65° C. or above, preferably 75° C. or above, and optimally 85° C. or above. The upper limit on the starting temperature for solidifying is preferably 195° C. The starting temperature for solidifying as used herein is measured by a differential scanning calorimeter (DSC), and is a temperature at which an exothermic peak attributed to solidification of the TPU appears while the TPU is being cooled at a rate of 10° C./min after heated to 230° C. at a rate of 10° C./min and at 230° C. for 5 minutes. The TPU having a starting temperature for solidifying of 65° C. or above can prevent defects such as fusion bonded fibers, broken filaments and resin masses in the spunbonding, and can prevent nonwoven fabrics to adhere to a embossing roll in a thermal embossing. In addition, the resultant nonwoven fabrics are less sticky, so that they are suitably used in materials which bring into contact with a skin, such as garments, hygiene materials and materials for sporting goods. On the other hand, when the TPU has a starting temperature for solidifying of 195° C. or below, the processing properties are improved. A starting temperature for solidifying of a fiber tends to be higher than that of the TPU used.

In order that the TPU can have a starting temperature for solidifying of not less than 65° C., optimum chemical structures are to be selected for its materials: a polyol, an isocyanate compound and a chain extender. In addition, the amount of hard segments should be carefully controlled. The amount of hard segments (wt %) is determined by dividing the total weight of the isocyanate compound and the chain extender with the total weight of the polyol, the isocyanate compound and the chain extender, and centuplicating the quotient. The amount of hard segments is preferably 20 to 60 wt %, more preferably 22 to 50 wt %, and optimally 25 to 48 wt %.

In the TPU, particles that are insoluble in a polar solvent totals $3.00\times10^6$ or less per g of TPU, preferably $2.50\times10^6$ or less per g of TPU, and optimally $2.00\times10^6$ or less per g of TPU. The polar-solvent insolubles are mainly aggregates such as fish-eyes and gels that are generated in a TPU production. The aggregates are components derived from the materials for the TPU and reaction products among those materials. Examples of such polar-solvent insolubles include derivatives from agglomerated hard segments, and hard segments and/or soft segments crosslinked together through allophanate linkages or biuret linkages.

The polar-solvent-insoluble particles are the insolubles occurring when the TPU is dissolved in dimethylacetamide (hereinafter "DMAC") as a solvent. They are counted on a particle size distribution analyzer, which utilizes an electrical sensing zone method, equipped with an aperture tube having an orifice of 100 μm in diameter. The aperture tube having an orifice of 100 μm in diameter can allow detection of particles which are 2 to 60 μm in terms of uncrosslinked polystyrene, and those particles are counted. The present inventors have found that the particle sizes in this range are closely related to the spinning stability for TPU-containing fiber mixture and the quality of the resulting elastic nonwoven fabric. When the polar-solvent-insoluble particles are $3.00\times10^6$ or less per g of TPU, the TPU having the aforesaid starting temperature for solidifying can prevent problems such as wide distribution of fiber diameter and filament breakage during the spinning. When such TPU has been spun, the fiber will have diameter equivalent to that of ordinary fabrics so that the resultant nonwoven fabric will have a superior touch, being suitable for hygiene materials and like items. Moreover, the TPU containing the polar-solvent-insoluble particles in the suitable number is difficult to clog a filter for impurities fitted in an extruder. This requires less frequent adjustment and maintenance of the apparatus, and is industrially preferred.

The TPU containing lesser polar-solvent-insolubles can be prepared by filtration of a crude TPU given after polymerization of a polyol, an isocyanate compound and a chain extender.

With respect to the TPU, a total heat of fusion (a) determined from endothermic peaks within the temperature range of from 90 to 140° C. and a total heat of fusion (b) determined from endothermic peaks within the temperature range of from above 140 to 220° C., which are measured on a differential scanning calorimeter (DSC), preferably satisfy the relation (1):

$$a/(a+b)\times100\leqq80 \quad (1);$$

more preferably satisfy the relation (2):

$$a/(a+b)\times100\leqq70 \quad (2);$$

and optimally satisfy the relation (3):

$$a/(a+b)\times100\leqq55 \quad (3)$$

wherein the left hand side "a/(a+b)×100" represents a ratio (%) of the heat of fusion attributed to the hard domains in the TPU.

When the above relational formula gives 80 or less, fibers, particularly spunbonded fibers, and nonwoven fabrics have improved strength and higher elasticity. In the invention, the lower limit on this ratio of the heat of fusion attributed to the hard domains in the TPU is suitably around 0.1.

The TPU preferably ranges in melt viscosity from 100 to 3000 Pa·s, more preferably from 200 to 2000 Pa·s, and optimally from 1000 to 1500 Pas as measured at 200° C. and 100 $sec^{-1}$ shear rate. The melt viscosity is a value determined by the use of a Capirograph (Toyo Seiki K.K., nozzle length: 30 mm, nozzle diameter: 1 mm).

The TPU preferably has a water content of 350 ppm or less, more preferably 300 ppm or less, and optimally 150 ppm or less. The TPU having a water content of 350 ppm or less can inhibits bubbles from being mixed into the strands and the filaments from breaking in the production of nonwoven fabrics with a large spunbonding machine.

<Production Method for Thermoplastic Polyurethane Elastomer>

As described hereinabove, the thermoplastic polyurethane elastomer may be produced from a polyol, an isocyanate compound and a chain extender that have optimal chemical structures. Exemplary processes for the production of the TPU include:

(i) a "prepolymer process" in which a polyol and an isocyanate compound are preliminarily reacted to give an isocyanato-terminated prepolymer (hereinafter "prepolymer") and the prepolymer is reacted with a chain extender; and (ii) a "one-shot process" in which a polyol and a chain extender are previously mixed and the mixture is reacted with an isocyanate compound.

Of these two, the prepolymer process is more preferable in view of mechanical characteristics and quality of the resultant TPU.

In the prepolymer process, the polyol and the isocyanate compound are mixed by stirring in the presence of an inert gas at around 40 to 250° C. for approximately 30 seconds to 8 hours to give a prepolymer; then the prepolymer is sufficiently mixed by high speed agitation with the chain extender in proportions such that the isocyanate index will be preferably 0.9 to 1.2, more preferably 0.95 to 1.15, and still preferably 0.97 to 1.08. Polymerization may be made at appropriate temperatures depending on the melting point of the chain extender and the viscosity of the prepolymer. For example, the polymerization temperature will be in the range of around 80 to 300° C., preferably 80 to 260° C., and optimally 90 to 220° C. The polymerization time will preferably range from about 2 seconds to 1 hour.

In the one-shot process, the polyol and the chain extender are mixed together and then degassed; thereafter the mixture is polymerized with the isocyanate compound by being stirred together at 40 to 280° C., preferably 100 to 260° C., for approximately 30 seconds to 1 hour. The isocyanate index in the one-shot process is preferably in the same range as in the prepolymer process.

<TPU Production Equipment>

The TPU may be continuously produced by reaction extrusion in a equipment comprised of a material storage tanks section, a mixer section, a static mixers section and a pelletizer section.

The material storage tanks section includes an isocyanate compound storage tank, a polyol storage tank, and a chain extender storage tank. Each storage tank is connected to a high-speed stirrer or a static mixers section (mentioned later) through a supply line having a gear pump and a downstream flow meter.

The mixer section has a mixing means such as a high-speed stirrer. The high-speed stirrer is not particularly limited if it is capable of high-speed mixing the aforesaid materials. Preferably, when the high-speed stirrer tank is equipped with a blade 4 cm in diameter and 12 cm around, it is capable of 300 to 5000 rpm (circumferential speed: 100 to 600 m/min), and desirably 1000 to 3500 rpm (circumferential speed: 120 to 420 m/min). The high-speed stirrer is preferably equipped with a heater (or a jacket) and a temperature sensor in order to detect changes in temperature in the stirring tank by means of the temperature sensor and accordingly condition the temperature by the heater.

The mixer section may optionally include a reaction pot, where the mixture of materials resulting from the high-speed stirring is temporarily kept to promote prepolymerization. The reaction pot preferably has a temperature control means. The reaction pot is preferably provided between the high-speed stirrer and a first static mixer in the most upstream position in the static mixers section.

The static mixers section preferably consists of plural static mixers connected in series. The static mixers (designated as the first static mixer 1, the second static mixer 2, the third static mixer 3, etc. from the upstream in the traveling direction for the materials) may have mixing elements of various figurations without limitation. For example, "Kagaku Kogaku no Shimpo (Advance of Chemical Engineering)" Vol. 24, Stirring and Mixing (edited by The Society of Chemical Engineers, Japan, Tokai Branch, and published from Maki Shoten on Oct. 20, 1990, first edition), in FIG. 10.1.1 on Page 155, illustrates Company-N type, Company-T type, Company-S type and Company-T type figurations. The static mixer having right element and left element arranged alternately is preferable. Optionally, the neighboring static mixers are connected by a straight pipe.

Each static mixer will range in length from 0.13 to 3.6 m, preferably 0.3 to 2.0 m, and more preferably 0.5 to 1.0 m, and have an inner diameter of 10 to 300 mm, preferably 13 to 150 mm, and more preferably 15 to 50 mm. The ratio of length to inner diameter (L/D) will range from 3 to 25, and preferably from 5 to 15. Each static mixer is preferably made of a substantially non-metallic material, such as fiber-reinforced plastic (FRP), in at least the liquid contact part thereof. Also preferably, each static mixer is coated with a fluorine-based resin, such as polytetrafluoroethylene, in at least the liquid contact part thereof. When the static mixers have the substantially non-metallic liquid contact parts, the polar-solvent insolubles are effectively prevented from occurring in the TPU. Exemplary static mixers include metallic static mixers whose inner walls are protected with fluorine-based resin tubes such as polytetrafluoroethylene tubes, and MX series commercially available from Noritake Company, Ltd.

Each static mixer is preferably equipped with a heater (or a jacket) and a temperature sensor in order to detect changes in temperature in the mixer by means of the temperature sensor and accordingly condition the temperature by the heater. This structure enables temperature control for individual static mixers depending on the composition of the materials. Accordingly, in the reduced catalyst amount, the TPU can be produced under optimum reaction conditions.

The first static mixer 1 in the most upstream position in the static mixers section is connected to the high-speed stirrer or the reaction pot of the mixer section. And the most downstream static mixer in the static mixers section is connected to a strand die of the pelletizer section or a single-screw extruder. The static mixers may be connected together in an arbitrary number depending on a desired mixing effect to meet the objective use of the TPU and the composition of the materials. For example, the static mixers may be serially connected 3 to 25 m long, and preferably 5 to 20 m long, or in 10 to 50 units, and preferably 15 to 35 units. Gear pumps may be optionally provided between the static mixers to control the flow rate.

The pelletizer section may be constituted with a known pelletizer such as an underwater pelletizer, or with a strand die and a cutter.

A single-screw extruder may be optionally arranged between the static mixers section and the pelletizer section in order to further knead the reaction product discharged from the static mixers section.

<TPU Production Method>

The TPU may be produced using an equipment as described above. For example, a mixture containing at least the isocyanate compound and the polyol is forced through the static mixers together with the chain extender, and these materials are polymerized as they mix together. Particularly preferably, polymerization will be made by a series of acts (steps) in which the isocyanate compound and the polyol are sufficiently mixed together in a high-speed stirrer and then further mixed with the chain extender by a high-speed stirrer, and these materials are reacted with each other while traveling through the static mixtures. Also preferably, the isocyanate compound and the polyol are first reacted to prepare a prepolymer, then the prepolymer is mixed with the chain extender in a high-speed stirrer, and the mixture is reacted in the static mixers.

The isocyanate compound and the polyol will be mixed together in a high-speed stirring tank at a residence time of 0.05 to 0.5 minute, preferably 0.1 to 0.4 minute, and at 60 to 150° C., preferably 80 to 140° C. When the mixture of the isocyanate compound and the polyol is kept in the reaction pot to promote prepolymerization, the residence time will be 0.1 to 60 minutes, and preferably 1 to 30 minutes, and the temperature will range from 80 to 150° C., and preferably from 90 to 140° C.

In either case, the mixture of the isocyanate compound and the polyol is fed together with the chain extender into the static mixtures to be polymerized. They may be fed to the static mixtures individually or after mixed together in a high-speed stirrer. As described earlier, the isocyanate compound and the polyol may be preliminarily reacted to give a prepolymer, and the prepolymer and the chain extender may be introduced into the static mixers with polymerization. The static mixers will have inside temperatures of 100 to 300° C., and preferably 150 to 280° C. The feed rate for the materials or the reaction product will be desirably set at 10 to 200 kg/h, and preferably 30 to 150 kg/h.

There are other processes useful to produce the TPU according to the invention. For example, the isocyanate compound, the polyol and the chain extender may be sufficiently mixed in a high-speed stirrer, and the mixture is continuously discharged on a belt and thereafter heated to induce polymerization.

These production processes afford the TPU containing lesser amount of the polar-solvent insolubles such as fish eye. The polar-solvent insolubles may be reduced by filtering the TPU. For example, the sufficiently dried TPU in pellet form may be extruded through an outlet head fitted with a filtering medium such as a metal mesh, a metallic nonwoven fabric or a polymer filter, thus filtering out the insolubles. The filtration can reduce the polar-solvent-insoluble particles to about $3\times10^4$ particles per g of TPU (lower limit). The extruder is preferably a single-screw extruder or a multi-screw extruder. The metal mesh usually has 100 meshes or above, preferably 500 meshes or above, and more preferably 1-000 meshes or above. A plural metal meshes which have the same or different mesh size each other are preferably used in piles. The polymer filters include Fuji Duplex Polymer Filter System (FUJI FILTER MGF. CO., LTD.), ASKA Polymer Filter System (ASKA Corporation) and DENA FILTER(NAGASE & CO. LTD.).

The TPU resulting from the above method may be crushed or finely divided by means of a cutter or a pelletizer, and then may be fabricated into desired shapes with an extruder or an injection molding machine.

<Polyol>

The polyol used in the production of the TPU is a polymer having two or more hydroxyl groups in the molecule. Examples thereof include polyoxyalkylene polyols, polytetramethylene ether glycols, polyester polyols, polycaprolactone polyols and polycarbonate diols. These may be used singly or in combination of two or more kinds. Polyoxyalkylene polyols, polytetramethylene ether glycols and polyester polyols are preferable.

The polyols are preferably dehydrated by being heated under reduced pressure until the water content lowers to a sufficient level. The water content will be preferably reduced to 0.05 wt % or below, more preferably 0.03 wt % or below, and even more preferably 0.02 wt % or below.

(Polyoxyalkylene Polyols)

Exemplary polyoxyalkylene polyols include polyoxyalkylene glycols, which are addition polymerized one or more relatively low-molecular weight divalent alcohols with alkylene oxides such as propylene oxide, ethylene oxide, butylene oxide and styrene oxide. Preferred polymerization catalysts include an alkali metal compound, such as cesium hydroxide or rubidium hydroxide, or a P═N having compound.

Of the aforesaid alkylene oxides, propylene oxide and ethylene oxide are particularly preferred. When two or more alkylene oxides are used, the propylene oxide will preferably account for at least 40 wt %, and more preferably at least 50 wt % of the total amount of alkylene oxides. When the alkylene oxides contain the propylene oxide in the above amount, the polyoxyalkylene polyol can contain oxypropylene groups in an amount of 40 wt % or more.

In order to attain higher durability and mechanical properties of the TPU, the polyoxyalkylene polyol will be preferably treated to convert at least 50 mol %, and more preferably at least 60 mol % of its molecular terminals to primary hydroxyl groups. Copolymerization with ethylene oxide at molecular terminals is a suitable way to achieve a desired level of conversion to the primary hydroxyl groups.

The polyoxyalkylene polyol used in the TPU production preferably ranges in number-average molecular weight from 200 to 8000, and more preferably from 500 to 5000. From the viewpoints of lowering the glass transition temperature and improving the fluidity of the TPU, two or more polyoxyalkylene polyols with different molecular weights and oxyalkylene group contents will be preferably used as a mixture in the production of the TPU. Moreover, the polyoxyalkylene polyol preferably contains a lesser amount of terminally unsaturated monols, the byproducts from addition polymerization with propylene oxide.

The monol content in the polyoxyalkylene polyol is expressed as a degree of unsaturation as described in JIS K-1557. The polyoxyalkylene polyol preferably has an unsaturation degree of 0.03 meq/g or below, and more preferably 0.02 meq/g or below. When the unsaturation degree exceeds 0.03 meq/g, the TPU tends to have poorer heat resistance and durability. The lower limit on the unsaturation degree will be suitably around 0.001 meq/g in consideration of the industrial production of polyoxyalkylene polyol.

(Polytetramethylene Ether Glycols)

The polyol may be polytetramethylene ether glycol (hereinafter "PTMEG") resulting from ring opening polymerization of tetrahydrofuran. PTMEG preferably has a number-average molecular weight of about 250 to 4000, and particularly preferably about 250 to 3000.

(Polyester Polyols)

Exemplary polyester polyols include polymers resulted from condensation between one or more low-molecular weight polyols and one or more carboxylic acids selected from low-molecular weight dicarboxylic acids and oligomer acids.

The low-molecular weight polyols include ethylene glycol, diethylene glycol, propylene glycol, dipropylene glycol, 1,3-propanediol, 1,4-butanediol, 1,5-pentanediol, 1,6-hexanediol, glycerol, trimethylolpropane, 3-methyl-1,5-pentanediol, hydrogenated bisphenol A and hydrogenated bisphenol F. The low-molecular weight dicarboxylic acids include glutaric acid, adipic acid, sebacic acid, terephthalic acid, isophthalic acid and dimer acid. Specific examples of the polyester polyols include polyethylene butylene adipate polyol, polyethylene adipate polyol, polyethylene propylene adipate polyol and polypropylene adipate polyol.

The polyester polyols preferably range in number-average molecular weight approximately from 500 to 4000, and particularly preferably from 800 to 3000.

(Polycaprolactone Polyols)

The polycaprolactone polyols may be obtained by ring opening polymerization of ϵ-caprolactones.

(Polycarbonate Diols)

Exemplary polycarbonate diols include products obtained by condensation between divalent alcohols such as 1,4-butanediol and 1,6-hexanediol, and carbonate compounds such as dimethyl carbonate, diethyl carbonate and diphenyl carbonate. The polycarbonate diols preferably have number-average molecular weights ranging approximately from 500 to 3000, and particularly preferably from 800 to 2000.

<Isocyanate Compound>

The isocyanate compound used in the TPU production may be an aromatic, aliphatic or alicyclic compound having two or more isocyanato groups in the molecule.

(Aromatic Polyisocyanates)

Exemplary aromatic polyisocyanates include 2,4-tolylene diisocyanate, 2,6-tolylene diisocyanate, isomeric mixtures of tolylene diisocyanates with 2,4-isomer: 2,6-isomer weight ratio of 80:20 (TDI-80/20) or 65:35 (TDI-65/35); 4,4'-diphenylmethane diisocyanate, 2,4'-diphenylmethane diisocyanate, 2,2'-diphenylmethane diisocyanate and isomeric mixtures of arbitrary isomers of these diphenylmethane diisocyanates; toluylene diisocyanate, xylylene diisocyanate, tetramethylxylylene diisocyanate, p-phenylene diisocyanate and naphthalene diisocyanate.

(Aliphatic Polyisocyanates)

Exemplary aliphatic polyisocyanates include ethylene diisocyanate, trimethylene diisocyanate, tetramethylene diisocyanate, hexamethylene diisocyanate, octamethylene diisocyanate, nonamethylene diisocyanate, 2,2'-dimethylpentane diisocyanate, 2,2,4-trimethylhexane diisocyanate, decamethylene diisocyanate, butene diisocyanate, 1,3-butadiene-1,4-diisocyanate, 2,4,4-trimethylhexamethylene diisocyanate, 1,6,11-undecamethylene triisocyanate, 1,3,6-hexamethylene triisocyanate, 1,8-diisocyanato-4-isocyanatomethyloctane, 2,5,7-trimethyl-1,8-diisocyanato-5-isocyanatomethyloctane, bis(isocyanatoethyl)carbonate, bis(isocyanatoethyl)ether, 1,4-butyleneglycol dipropylether-ω,ω-diisocyanate, lysin isocyanatomethyl ester, lysin triisocyanate, 2-isocyanatoethyl-2,6-diisocyanatohexanoate, 2-isocyanatopropyl-2,6-diisocyanatohexanoate and bis(4-isocyanato-n-butylidene)pentaerythritol.

(Alicyclic Polyisocyanates)

Exemplary alicyclic polyisocyanates include isophorone diisocyanate, bis(isocyanatomethyl)cyclohexane, dicyclohexylmethane diisocyanate, cyclohexane diisocyanate, methylcyclohexane diisocyanate, 2,2'-dimethyldicyclohexylmethane diisocyanate, dimer acid diisocyanate, 2,5-diisocyanatomethyl-bicyclo[2.2.1]-heptane, 2,6-diisocyanatomethyl-bicyclo[2.2.1]-heptane, 2-isocyanatomethyl-2-(3-isocyanatopropyl)-5-isocyanatomethyl-bicyclo[2.2.1]-heptane, 2-isocyanatomethyl-2-(3-isocyanatopropyl)-6-isocyanatomethyl-bicyclo[2.2.1]-heptane, 2-isocyanatomethyl-3-(3-isocyanatopropyl)-5-(2-isocyanatoethyl)-bicyclo[2.2.1]-heptane, 2-isocyanatomethyl-3-(3-isocyanatopropyl)-6-(2-isocyanatoethyl)-bicyclo[2.2.1]-heptane, 2-isocyanatomethyl-2-(3-isocyanatopropyl)-5-(2-isocyanatoethyl)-bicyclo[2.2.1]-heptane and 2-isocyanatomethyl-2-(3-isocyanatopropyl)-6-(2-isocyanatoethyl)-bicyclo[2.2.1]-heptane.

These polyisocyanates may be used in modified forms with urethanes, carbodiimides, urethoimines, biurets, allophanates or isocyanurates.

Preferable polyisocyanates include 4,4'-diphenylmethane diisocyanate (MDI), hydrogenated MDI (dicyclohexylmethane diisocyanate (HMDI)), p-phenylene diisocyanate (PPDI), naphthalene diisocyanate (NDI), hexamethylene diisocyanate (HDI), isophorone diisocyanate (IPDI), 2,5-diisocyanatomethyl-bicyclo[2.2.1]-heptane (2,5-NBDI) and 2,6-diisocyanatomethyl-bicyclo[2.2.1]-heptane (2,6-NBDI). Of these, MDI, HDI, HMDI, PPDI, 2,5-NBDI and 2,6-NBDI are preferably used. These diisocyanates also be preferably used in modified forms with urethanes, carbodiimides, urethoimines or isocyanurates.

<Chain Extender>

The chain extender used in the TPU production is preferably an aliphatic, aromatic, heterocyclic or alicyclic, low-molecular weight polyol having two or more hydroxyl groups in the molecule. The chain extender is preferably dehydrated by being heated under reduced pressure until its water content lowers to a sufficient level. The water content will be preferably reduced to 0.05 wt % or below, more preferably 0.03 wt % or below, and even more preferably 0.02 wt % or below.

The aliphatic polyols include ethylene glycol, propylene glycol, 1,3-propanediol, 1,4-butanediol, 1,5-pentanediol, 1,6-hexanediol, glycerol and trimethylolpropane. The aromatic, heterocyclic or alicyclic polyols include p-xylene glycol, bis(2-hydroxyethyl) terephthalate, bis(2-hydroxyethyl) isophthalate, 1,4-bis(2-hydroxyethoxy) benzene, 1,3-bis(2-hydroxyethoxy) benzene, resorcin, hydroquinone, 2,2'-bis(4-hydroxycyclohexyl) propane, 3,9-bis(1,1-dimethyl-2-hydroxyethyl)-2,4,8,10-tetraoxaspiro[5.5]undecane, 1,4-cyclohexanedimethanol and 1,4-cyclohexanediol.

The chain extenders may be used singly or in combination of two or more kinds.

<Catalyst>

The TPU may be produced under catalysis by a common catalyst, such as organometallic compounds, widely used in preparing polyurethanes. Suitable catalysts include organometallic compounds such as tin acetate, tin octylate, tin oleate, tin laurate, dibutyltin diacetate, dibutyltin dilaurate, dibutyltin dichloride, zinc octanoate, zinc naphthenate, nickel naphthenate and cobalt naphthenate. These catalysts may be used singly or in combination or two or more kinds. The catalyst(s) will be used in an amount of 0.0001 to 2.0 parts by weight, and preferably 0.001 to 1.0 part by weight, based on 100 parts by weight of the polyol.

<Additives>

The TPU is preferably incorporated with an additive such as a heat stabilizer or a light stabilizer. The additives may be added either during or after the production of the TPU, but preferably they are preliminary dissolved within the reaction materials during the production of the TPU.

The heat stabilizers include hindered phenolic antioxidants, and phosphorous-, lactone- or sulfur-based heat stabilizers. Specific examples are IRGANOX series 1010, 1035, 1076, 1098, 1135, 1222, 1425WL, 1520L, 245, 3790, 5057, IRGAFOS series 168, 126, and HP-136 (all available from Ciba Specialty Chemicals).

The light stabilizers include benzotriazole-, triadine- or benzophenone-based ultraviolet light absorbers, benzoate-based light stabilizers and hindered amine-based light stabilizers. Specific examples are TINUVIN P, TINUVIN series 234, 326, 327, 328, 329, 571, 144, 765 and B75 (all available from Ciba Specialty Chemicals).

The heat stabilizers and the light stabilizers each are preferably used in an amount of 0.01 to 1 wt %, and more preferably 0.1 to 0.8 wt % of TPU.

The TPU may be optionally incorporated with further additives, including hydrolysis inhibitors, releasing agents, colorants, lubricants, rust preventives and fillers.

<Polymer A>

The aforesaid thermoplastic polyurethane elastomer (TPU) may be individually employed as the polymer A to form the fiber A. Meanwhile, it is also possible to use other thermoplastic polymer (s) in combination with TPU without adversely affecting the objects of the invention. When the polymer A is comprised of the TPU and the other thermoplastic polymer (s), it preferably contains the TPU in an amount of 50 wt % or above, more preferably 65 wt % or above, and optimally 80 wt % or above. When the polymer A contains 50 wt % or above of the TPU, the elastic nonwoven fabric obtained therefrom will have sufficient elasticity and low residual strain. For example, such elastic nonwoven fabrics may be suitably used in garments, hygiene materials and materials for sporting goods that are required to repeatedly exhibit stretching properties.

(Other Thermoplastic Polymers)

The other thermoplastic polymers are not particularly limited if they can form nonwoven fabrics. Examples thereof include styrene elastomers, polyolefin elastomers, vinyl chloride elastomers, polyesters, ester elastomers, polyamides, amide elastomers, polyolefins such as polyethylene, polypropylene and polystyrene, and polylactic acids.

The styrene elastomers include diblock and triblock copolymers based on a polystyrene block and either a butadiene rubber block or an isoprene rubber block. These rubber blocks may be unsaturated or completely hydrogenated. Specific examples of the styrene elastomers include elastomers commercially available under the trade names of KRATON polymers (Shell Chemicals), SEPTON (KURARAY CO., LTD.), TUFTEC (Asahi Kasei Corporation) and LEOSTOMER(RIKEN TECHNOS CO.).

The polyolefin elastomers include ethylene/α-olefin copolymers and propylene/α-olefin copolymers. Specific examples thereof include TAFMER (Mitsui Chemicals, Inc.), Engage (ethylene/octene copolymer, DuPont Dow Elastomers) and CATALLOY (crystalline olefin copolymer, MONTELL).

The vinyl chloride elastomers include LEONYL (RIKEN TECHNOS CO., LTD) and Posmere (Shin-Etsu Polymer Co.).

The ester elastomers include HYTREL (E.I. DuPont) and PELPRENE (TOYOBO CO., LTD.).

The amide elastomers include PEBAX (ATOFINA Japan Co., Ltd.).

Other exemplary thermoplastic polymers include DUMILAN (ethylene/vinyl acetate/vinyl alcohol copolymer, Mitsui Takeda Chemicals, Inc.), NUCREL (ethylene/(meth)acrylic acid copolymer resin, DUPONT-MITSUI POLYCHEMICALS CO., LTD.) and ELVALOY (ethylene/acrylic ester/carbon oxide terpolymer, DUPONT-MITSUI POLYCHEMICALS CO., LTD.).

These other thermoplastic polymers may be melt blended with TPU, then pelletized and thereafter spun. Alternatively, they may be pelletized, then blended with TPU pellets and spun together.

(Additives)

The polymer A may contain additives, including various stabilizers such as heat stabilizers and weathering stabilizers, antistatic agents, slip agents, anti-fogging agents, lubricants, dyes, pigments, natural oils, synthetic oils and waxes.

Exemplary stabilizers include anti-aging agents such as 2,6-di-t-butyl-4-methylphenol (BHT); phenolic antioxidants such as tetrakis[methylene-3-(3,5-di-t-butyl-4-hydroxyphenyl)propionato]methane, β-(3,5-di-t-butyl-4-hydroxyphenyl) propionic acid alkyl ester, 2,2'-oxamidobis[ethyl-3-(3,5-di-t-butyl-4-hydroxyphenyl)] propionate and Irganox 1010 (trade name, hindered phenolic antioxidant); metal salts of fatty acids, such as zinc stearate, calcium stearate and calcium 1,2-hydroxystearate; and fatty acid esters of polyvalent alcohols, such as glycerin monostearate, glycerin distearate, pentaerythritol monostearate, pentaerythritol distearate and pentaerythritol tristearate. These stabilizers may be used singly or in combination of two or more kinds.

<Thermoplastic Polymer B>

The thermoplastic polymer B (hereinafter "polymer B") is a different thermoplastic polymer from the aforesaid thermoplastic polyurethane elastomer and is not particularly limited if it can form a fiber mixture and a nonwoven fabric comprising the fiber mixture. Preferable polymer B can form a fiber that is less elastic than a fiber comprising the polymer A. Optimal polymer B can be form an inelastic fiber which is extensible. When an elastic nonwoven fabric is produced from the polymer B capable of forming the extensible fibers, it will be excellent in bulkiness and touch attributed to a stretching and be capable of staying in an extension.

Exemplary thermoplastic polymer B include styrene elastomers, polyolefin elastomers, vinyl chloride elastomers, polyesters, ester elastomers, polyamides, amide elastomers, polyolefins such as polyethylene, polypropylene and polystyrene, and polylactic acids. These may be used singly or in combination of two or more kinds. When two or more of these thermoplastic polymers are used in combination, they may be blended together prior to spinning, or may be spun in distinguishable forms to form a conjugate fiber.

Specific examples for the other thermoplastic polymers are as described hereinabove with respect to the polymer A.

When the elastic nonwoven fabric is intended for hygiene materials such as disposable diapers, the thermoplastic polymer B will be preferably selected from the polyolefins, particularly polyethylene and polypropylene, since they enable the resultant elastic nonwoven fabric to display comfortable touch as well as to have excellent heat sealing properties with respect to other diaper components.

<Fiber Mixture and Elastic Nonwoven Fabric>

The fiber mixture and the elastic nonwoven fabric of the invention may be produced from the polymer A containing the aforesaid thermoplastic polyurethane elastomer and the thermoplastic polymer B, for example, by a spunbonding. The spunbonding used in the Invention may be publicly known. JP-A-2002-242069 discloses an exemplary spunbonding method.

Specifically, the polymers A and B are each molten in respective extruders (Act (Step) (I)), and they are separately introduced to the same die and extruded simultaneously through respective nozzles fitted in the die to form fibers A comprising the polymer A and fibers B comprising the polymer B. The die temperature is usually 180 to 240° C., preferably 190 to 230° C., more preferably 200 to 225° C. A large number of fibers given by a melt spinning are introduced into a cool chamber, quenched with cooling air in, drawn with drawing air, and deposited on a moving collecting surface to form a fiber mixture (Act (Step) (II)). From the viewpoints of economical efficiency and spinnability, the cooling air temperature is usually 5 to 50° C., preferably 10 to 40° C., more preferably 15 to 30° C. The drawing air velocity is usually 100 to 10,000 m/min, preferably 500 to 10,000 m/min.

These acts (steps) afford a fiber mixture that contains fibers A comprising the polymer A and fibers B comprising the polymer B. When the polymer B contains an elastomer, the fiber B is elastic. On the other hand, when the polymer B contains no elastomer, the fiber B is inelastic.

The fiber mixture generally has fiber diameters of 50 μm or less, preferably 40 μm or less, and more preferably 30 μm or less. The fiber mixture contains the fiber A in an amount of 10 wt % or more, preferably 20 wt % or more, and still preferably 40 wt % or more.

After the fiber mixture deposited on a moving collecting surface in a web form, the deposition is partially entangled or fusion bonded (Act (Step) (III)). The entangle treatment may be carried out by needle punching, water jetting or ultrasonic sealing, and the fusion bonding may be effected with a thermal embossing roll. Fusion bonding with a thermal embossing roll is preferably employed. The thermal embossing temperature is usually 50 to 160° C., and preferably 70 to 150° C. The thermal embossing roll may have an arbitrary embossing area percentage, which although is preferably between 5 and 30%.

The partially entangled or fusion bonded fiber mixture is then stretched (Act (Step) (IV)) to give the elastic nonwoven fabric of the invention. Stretched nonwoven fabrics exhibit further improved touch and elasticity. The stretching may be carried out in a conventional manner in the art and may be effected partially or entirely. The stretching may be effected uniaxially or biaxially. Stretching in the machine direction (MD) may be performed by passing the partially bonded fiber mixture through two or more sets of nip rolls, with each set of nip rolls being operated faster than the previous set. Further, gear stretching may be performed using stretching gears as illustrated in FIG. 1.

The draw ratio will be preferably 50% or above, more preferably 100% or above, and optimally 200% or above, but will be preferably 1000% or below, and more preferably 400% or below. The above draw ratio is for the machine direction (MD) or the cross direction (CD) perpendicular to the MD in the uniaxial stretching, or is for the machine direction (MD) and the cross direction (CD) in the biaxial stretching. The nonwoven fabric stretched at the aforesaid draw ratio has a fiber diameter of usually 50 μm or less, preferably 40 μm or less, and still preferably 30 μm or less.

The stretched nonwoven fabric will display excellent fuzz resistance and more comfortable touch, and will be suitable for hygiene materials including disposable diapers, sanitary napkins and urine absorbent pads. In particular, these properties may be exhibited at further improved levels when the fiber mixture that contains the fibers A comprising the TPU-containing polymer and the extensible fibers B comprising polyethylene and/or polypropylene, is stretched at the above draw ratio.

The elastic nonwoven fabric has excellent heat sealing properties. Accordingly, the nonwoven fabric can form a laminate with other nonwoven fabric(s), the laminate having excellent interlaminar adhesion. Due to this superior heat sealability, separation of nonwoven fabric layers is very unlikely to occur. When the other nonwoven fabric(s) also has extensible properties, the resultant laminate has a more excellent touch.

The elastic nonwoven fabric has a residual strain of 50% or less, preferably 35% or less, and more preferably 30% or less after 100% elongation. The residual strain of 50% or less can make less noticeable the deformation of nonwoven fabric products such as garments, hygiene materials and materials for sporting goods.

The elastic nonwoven fabric ranges in basis weight from 3 to 200 g/cm$^2$, and preferably from 5 to 150 g/cm$^2$.

<Laminate>

The laminate according to the invention includes at least one layer comprising the aforesaid elastic nonwoven fabric. The laminate may be produced by a series of acts (steps) in which:

a fiber mixture is deposited as described hereinabove;

then an extensible nonwoven fabric is laminated on the deposit; and those nonwoven fabric layers are fusion bonded and then stretched.

For example, the fusion bonding may be accomplished with use of the aforesaid entangle treatment or fusion bonding, preferably a thermal embossing. The embossing area percentage and the draw ratio are preferably within the aforesaid ranges. The stretching may be carried out by the methods described with respect to the elastic nonwoven fabric according to the invention.

The extensible nonwoven fabric is not particularly limited if it can be stretched to the elastic limit of the elastic nonwoven fabric according to the invention. When the laminate is intended for hygiene materials such as disposable diapers, the extensible nonwoven fabric is preferably made up of a polymer containing polyolefin, particularly polyethylene and/or polypropylene, from the viewpoints of superior touch, high elasticity and excellent heat sealing properties. When the thermal embossing is employed in the production of the laminate, the extensible nonwoven fabric is preferably comprised of a polymer that has good compatibility and bondability with the elastic nonwoven fabric according to the invention.

The fibers constituting the extensible nonwoven fabric preferably have a monocomponent configuration, a sheath-core configuration, a segmented configuration, an islands-in-the-sea configuration or a side-by-side configuration. The extensible nonwoven fabric comprises a mixture of fibers having the different configurations.

A laminate of the invention may be produced by laminating a thermoplastic polymer film on the layer comprising the elastic nonwoven fabric. The thermoplastic polymer film may be breathable or perforated film.

Due to the excellent heat sealing properties of the nonwoven fabric layer comprising the fiber mixture of the invention, the layers constituting the laminate will not separate from one another. Moreover, this elastic laminate has exceptional touch.

EXAMPLES

The present invention will be described by the following Examples, but it should be construed that the invention is in no way limited thereto. In Examples and Comparative Examples, TPUs were analyzed and tested to determine their properties by the procedures illustrated hereinbelow.

(1) Starting Temperature for Solidifying

The starting temperature for solidifying was obtained on a differential scanning calorimeter (DSC 220C) connected to a Disc Station Model SSC 5200H (Seiko Instruments Inc.). Approximately 8 mg of the sample, ground TPU, was weighed on an aluminum pan, which was then capped and crimped. A reference was prepared in the same manner using alumina. After the sample and the reference were put in place in the cell, an experiment was carried out in a nitrogen stream fed at a flow rate of 40 Nml/min. The temperature was raised from room temperature to 230° C. at a rate of 10° C./min, maintained at the temperature for 5 minutes, and lowered to −75° C. at a rate of 10° C./min. From the exothermic profile recorded in this experiment, the starting point (initial rise temperature) of the exothermic peak attributed to the solidification of TPU was obtained as the starting temperature for solidifying) (C.°).

(2) Number of Polar-Solvent-Insoluble Particles

Polar-solvent-insoluble particles were counted on a particle size distribution analyzer Multisizer II (Beckman Coulter, Inc.) based on an electrical sensing zone method. A 5-L separable flask was charged with 3500 g of dimethylacetamide (Wako Special Grade, available from Wako Pure Chemical Industries, Ltd.) and 145.83 g of ammonium thiocyanate (special grade, available from JUNSEI CHEMICAL CO., LTD.). They were brought to a solution at room temperature over a period of 24 hours. The solution was filtered through a 1 μm-membrane filter under reduced pressure. A reagent A was thus obtained. Thereafter, 180 g of the reagent A and 2.37 g of TPU pellets were precisely weighed into a 200 cc glass bottle. Soluble components of TPU were allowed to dissolve over a period of 3 hours. The solution thus obtained was used as a sample. A 100 μm-aperture tube was attached to the Multisizer II, and the existing solvent in the analyzer was replaced with the reagent A. The pressure was reduced to nearly 3000 mmAq. Thereafter, the reagent A was weighed in an amount of 120 g into a beaker which had been sufficiently washed. Blank measurement was carried out to provide that pulses appeared at a rate of 50 or less per minute. After the optimum current and gain had been set manually, calibration was made using 10 μm standard particles of uncrosslinked polystyrene. To carry out the measurement, a sufficiently washed beaker was charged with 120 g of the reagent A and about 10 g of the sample. The measurement was conducted for 210 seconds. The number of particles counted during this measurement was divided by the amount of TPU aspirated into the aperture tube to determine the number of polar-solvent-insoluble particles in the TPU (particles/g). The amount of TPU is calculated by the following formula:

$$\text{TPU amount}=\{(A/100)\times B/(B+C)\}\times D$$

wherein A is a TPU concentration in the sample (wt %), B is an amount of the sample weighted into the beaker, C is an amount of the reagent A weighted into the beaker, and D is an amount of the solution aspirated into the aperture tube during the measurement (for 210 seconds).

(3) Ratio of Heat of Fusion Attributed to Hard Domains

The ratio of the heat of fusion attributed to the hard domains was obtained on a differential scanning calorimeter (DSC 220C) connected to a Disc Station Model SSC 5200H (Seiko Instruments Inc.). Approximately 8 mg of the sample, ground TPU, was placed on an aluminum pan, which was then capped and crimped. A reference was prepared in the same manner using alumina. After the sample and the reference were put in place in the cell, an experiment was carried out in a nitrogen stream fed at a flow rate of 40 Nml/min. The temperature was raised from room temperature to 230° C. at a rate of 10° C./min. From the endothermic profile recorded in this experiment, the total heat of fusion (a) determined from endothermic peaks within the temperature range of from 90 to 140° C. and the total heat of fusion (b) determined from endothermic peaks within the temperature range of from above 140 to 220° C. were obtained. These values were substituted to the following equation to determine the ratio of the heat of fusion attributed to the hard domains:

$$\text{Heat of fusion}(\%)=a/(a+b)\times 100$$

(4) Melt Viscosity at 200° C.

The melt viscosity (Pa·s) at 200° C. (hereinafter "melt viscosity") was determined for TPU at a shear rate of 100 $sec^{-1}$ on a Capirograph Model 1C (Toyo Seiki K.K.) having a nozzle 30 mm in length and 1 mm in diameter.

(5) The Water Content in TPU

The water content (ppm) in TPU was measured on a water content measurement device Model AVQ-5S and an evaporator Model EV-6 (both available from HIRANUMA SANGYO Co., Ltd.). Approximately 2 g of TPU pellets were weighed on a pan and introduced into a 250° C. hot oven. The evaporated water was led to a water-free titration cell of the water content measurement device and titration was performed using a Karl Fischer reagent. When the voltage between the electrodes remained unchanged for 20 seconds, it was considered that the water content in the cell had ceased to increase so that the titration was terminated.

(6) Hardness (Shore A)

TPU was tested in accordance with JIS K-7311 at 23° C. and 50% RH to determine the hardness. A durometer Type A was used in the test.

(7) Occurrence of Filament Breakage

Spinning was visually observed from the vicinity of the spinneret to count the occurrence of filament breakage for 5 minutes (times/5 min). The "filament breakage" was counted when single filament broke during the spinning, and was disregarded when adhered filaments broke (which was separately counted as fusion bonded fibers).

(8) Occurrence of Fusion Bonded Fibers

Spinning was visually observed from the vicinity of the spinneret to count the occurrence of fusion bonded fibers for 5 minutes (times/5 min).

<TPU Production Example 1>

In an atmosphere of nitrogen, 280.3 parts by weight of 4,4'-diphenylmethane diisocyanate (hereinafter "MDI") (trade name: Cosmonate PH, available from Mitsui Takeda Chemicals, Inc.) was placed in an isocyanate compound storage tank (hereinafter "tank A") and heated to 45° C. with agitation while avoiding bubbles.

Separately, a polyol storage tank (hereinafter "tank B") was charged under a nitrogen atmosphere with:

219.8 parts by weight of polyester polyol having a number-average molecular weight of 1000 (trade name: Takelac U2410, available from Mitsui Takeda Chemicals, Inc.);

439.7 parts by weight of polyester polyol having a number-average molecular weight of 2000 (trade name: Takelac U2420, available from Mitsui Takeda Chemicals, Inc.);

2.97 parts by weight of bis(2,6-diisopropyl phenyl) carbodiimide (trade name: Stabilizer 7000, available from RASCHIG GmbH);

2.22 parts by weight of a hindered phenolic antioxidant (trade name: Irganox 1010, available from Ciba Specialty Chemicals); and 2.22 parts by weight of a benzotriazole-based ultraviolet light absorber (trade name: JF-83, available from Johoku Chemical Co., Ltd).

The contents were brought to 90° C. under agitation. This mixture will be refereed to as the polyol solution 1.

Subsequently, 60.2 parts by weight of a chain extender, 1,4-butanediol (BASF JAPAN), was introduced into a chain extender storage tank (hereinafter "tank C") in an atmosphere of nitrogen and brought to 50° C.

These materials had amounts that would allow estimation of the hard segment amount to be 34 wt %.

Thereafter, MDI and the polyol solution 1 were supplied though liquid-supply lines with gear pumps and flow meters at constant flow rates of 16.69 kg/h and 39.72 kg/h respectively to a high-speed stirrer temperature-controlled at 120° C. (Model SM40 available from Sakura Plant). After they had been mixed by stirring at 2000 rpm for 2 min, the liquid mixture was supplied to a stirrer-equipped reaction pot temperature-controlled at 120° C. Subsequently, the liquid mixture and 1,4-butanediol were supplied from the reaction pot and the tank C at constant flow rates of 56.41 kg/h and 3.59 kg/h respectively to a high-speed stirrer (Model SM40) temperature-controlled at 120° C., and they were mixed by stirring at 2000 rpm for 2 min. The resultant mixture was passed though a series of static mixers whose insides had been coated with Teflon™ or protected with a Teflon™ tube. The static mixers section consisted of a series of 1st to 3rd static mixers whose each is 0.5 m in length and 20 mm in inner diameter (temperature: 250° C.), 4th to 6th static mixers whose each is 0.5 m in length and 20 mm in inner diameter (temperature: 220° C.), 7th to 12th static mixers whose each is 1.0 m in length and 34 mm in inner diameter (temperature: 210° C.), and 13th to 15th static mixers whose each is 0.5 m in length and 38 mm in inner diameter (temperature: 200° C.).

The reaction product discharged from the 15th static mixer was introduced via a gear pump into a single-screw extruder (65 mm in diameter, temperature controlled at 200 to 215° C.) which was fitted at an outlet head with a polymer filter (DENA FILTER available from NAGASE & CO. LTD.), and forced through a strand die. The resultant strands were water-cooled and consecutively cut by a pelletizer. The pellets were maintained in a dryer at 85 to 90° C. over a period of 8 hours. Thus, a thermoplastic polyurethane elastomer (TPU-1) with a water content of 65 ppm resulted.

The tests provided that TPU-1 had a starting temperature for solidifying of 115.6° C. and contained $1.40\times10^6$ polar-solvent-insoluble particles per g. Separately, TPU-1 was injection molded into a specimen, which was found to have a hardness of 86 A. TPU-1 had a 200° C. melt viscosity of 2100 Pas and a ratio of the heat of fusion attributed to the hard domains of 62.8%.

<TPU Production Example 2>

In a nitrogen atmosphere, 288.66 parts by weight of MDI was introduced into the tank A and heated to 45° C. with agitation while avoiding bubbles.

Separately, the tank B was charged under a nitrogen atmosphere with:

216.2 parts by weight of polytetramethylene ether glycol having a number-average molecular weight of 1000 (trade name: PTG-1000, available from Hodogaya Chemicals);

432.5 parts by weight of polyester polyol having a number-average molecular weight of 2000 (trade name: Takelac U2720, available from Mitsui Takeda Chemicals, Inc.);

2.22 parts by weight of Irganox 1010; and 2.22 parts by weight of JF-83.

The contents were brought to 95° C. under agitation. This mixture will be refereed to as the polyol solution 2.

Subsequently, 62.7 parts by weight of a chain extender, 1,4-butanediol, was introduced into the tank C in an atmosphere of nitrogen and brought to 50° C.

These materials had amounts that would allow estimation of the hard segment amount to be 35 wt %.

Thereafter, MDI and the polyol solution 2 were supplied though liquid-supply lines with gear pumps and flow meters at constant flow rates of 17.24 kg/h and 39.01 kg/h respectively to a high-speed stirrer (Model SM40) temperature-controlled at 120° C. After they had been mixed by stirring at 2000 rpm for 2 min, the liquid mixture was supplied to a stirrer-equipped reaction pot temperature-controlled at 120° C. Subsequently, the liquid mixture and 1,4-butanediol were supplied from the reaction pot and the tank C at constant flow rates of 56.25 kg/h and 3.74 kg/h respectively to a high-speed stirrer (Model SM40) temperature-controlled at 120° C., and they were mixed by stirring at 2000 rpm for 2 min. The resultant mixture was passed though a series of the static mixers as described in Production Example 1.

The reaction product discharged from the 15th static mixer was pelletized in the same manner as in Production Example 1. The pellets were maintained in a dryer at 85 to 90° C. over a period of 8 hours. Thus, a thermoplastic polyurethane elastomer (TPU-2) with a water content of 70 ppm resulted.

The tests provided that TPU-2 had a starting temperature for solidifying of 106.8° C. and contained $1.50\times10^6$ polar-solvent-insoluble particles per g. Separately, TPU-2 was injection molded into a specimen, which was found to have a hardness of 85 A. TPU-2 had a 200° C. melt viscosity of 1350 Pa·s and a ratio of the heat of fusion attributed to the hard domains of 55.1%.

<TPU Production Example 3>

In an atmosphere of nitrogen, MDI was placed in the tank A and heated to 45° C. with agitation while avoiding bubbles.

Separately, the tank B was charged under a nitrogen atmosphere with:

628.6 parts by weight of polyester polyol having a number-average molecular weight of 2000 (trade name: Takelac U2024, available from Mitsui Takeda Chemicals, Inc.);

2.21 parts by weight of Irganox 1010; and 77.5 parts by weight of 1,4-butanediol.

The contents were brought to 95° C. under agitation. This mixture will be refereed to as the polyol solution 3.

These materials had amounts that would allow estimation of the hard segment amount to be 37.1 wt %.

Thereafter, MDI and the polyol solution 3 were supplied though liquid-supply lines with gear pumps and flow meters at constant flow rates of 17.6 kg/h and 42.4 kg/h respectively to a high-speed stirrer (Model SM40) temperature-controlled at 120° C. After they had been mixed by stirring at 2000 rpm for 2 min, the liquid mixture was passed through a series of static mixers in the same manner as in Production Example 1. The static mixers section consisted of a series of 1st to 3rd static mixers whose each is 0.5 m in length and 20 mm in inner diameter (temperature: 230° C.), 4th to 6th static mixers whose each is 0.5 min length and 20 mm in inner diameter (temperature: 220° C.), 7th to 12th static mixers whose each is 1.0 m in length and 34 mm in inner diameter (temperature: 210° C.), and 13th to 15th static mixers whose each is 0.5 min length and 38 mm in inner diameter (temperature: 200° C.).

The reaction product discharged from the 15th static mixer was introduced via a gear pump into a single-screw extruder (65 mm in diameter, temperature controlled at 180 to 210° C.) which was fitted at an outlet head with a polymer filter (DENA FILTER available from NAGASE & CO. LTD.) and forced through a strand die. The resultant strands were water-cooled and consecutively cut by a pelletizer. The pellets were maintained in a dryer at 100° C. over a period of 8 hours. Thus, a thermoplastic polyurethane elastomer with a water content of 40 ppm resulted. The thermoplastic polyurethane elastomer was then continuously extruded on a single-screw extruder (50 mm in diameter, temperature-controlled at 180 to 210° C.) and were pelletized. The pellets were maintained in a dryer at 100° C. over a period of 7 hours. Thus, a thermoplastic polyurethane elastomer (TPU-4) with a water content of 57 ppm resulted.

The tests provided that TPU-4 had a starting temperature for solidifying of 103.7° C. and contained $1.50\times10^6$ polar-solvent-insoluble particles per g. Separately, TPU-4 was injection molded into a specimen, which was found to have a hardness of 86 A. TPU-4 had a 200° C. melt viscosity of 1900 Pa·s and a ratio of the heat of fusion attributed to the hard domains of 35.2%.

Example 1

(1) Preparation of Spunbonded Nonwoven Fabric 96 parts by weight of a propylene homopolymer (hereinafter "PP-1") that had MFR (ASTM D1238, 230° C., 2.16 kg load) of 60 g/10 min, a density of 0.91 g/cm$^3$ and a melting point of 160° C., and 4 parts by weight of a high-density polyethylene (hereinafter "HDPE") that had MFR (ASTM D1238, 190° C., 2.16 kg load) of 5 g/10 min, a density of 0.97 g/cm$^3$ and a melting point of 134° C. were mixed together to give a thermoplastic polymer B-1.

Figure 2:
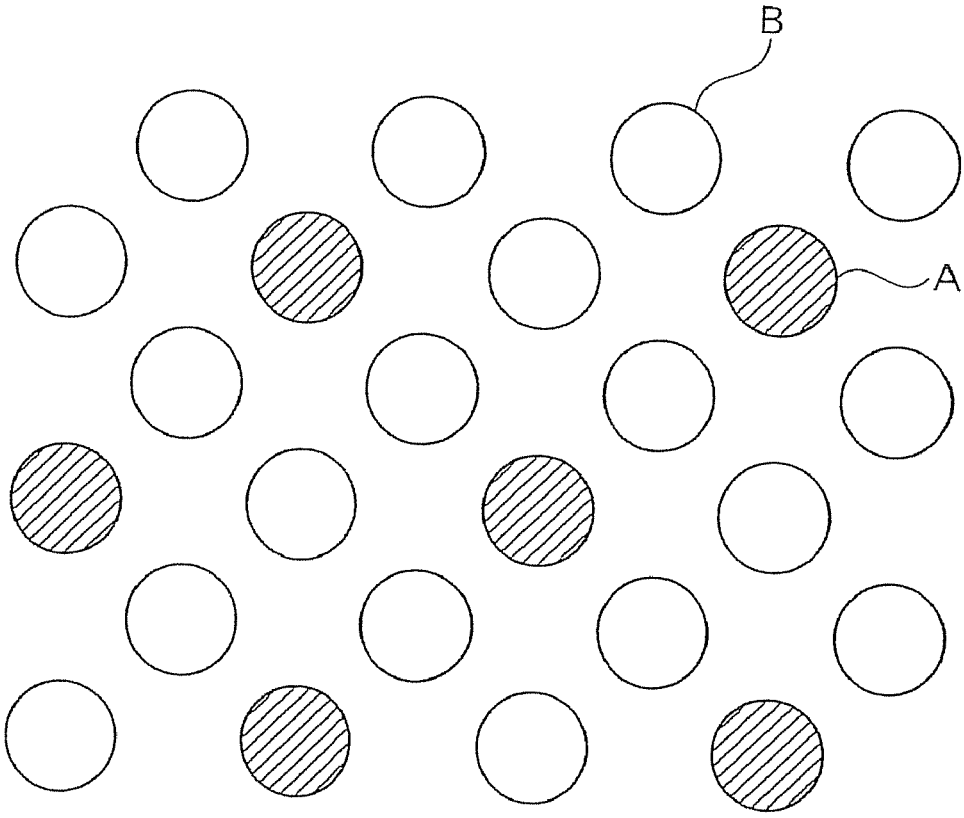
Fig. 2 Prior Art
FIG. 2 is a schematic view showing a spinneret used to produce a fiber mixture wherein A and B indicate nozzles for a fiber A and a fiber B respectively.

TPU-1 obtained in Production Example 1 and the thermoplastic polymer B-1 were molten in respective extruders (30 mm in diameter) and subsequently melt spun by a spunbond machine (length in a cross direction of collecting surface: 100 mm) having a spinneret illustrated in FIG. 2. The spunbonding was performed at resin and die temperatures of 220° C., a cooling air temperature of 20° C., and a drawing air velocity of 3000 m/min. The resultant fiber mixture containing fibers A of TPU-1 and fibers B of the thermoplastic polymer B-1 was deposited on a collecting surface in a web form. The spinneret had nozzles arranged as illustrated in FIG. 2. The nozzles were 0.6 mm in diameter and had pitches of 8 mm longitudinally and 8 mm transversely. The nozzles for the fiber A and those for the fiber B were arranged in a ratio of 1:3 (fiber A nozzles:fiber B nozzles). The outputs of the fiber A and fiber B were 1.0 g/min and 0.45 g/min per nozzle respectively.

The traveling speed of the collecting surface (web former) was set to 20 m/min, and the web was embossed at 80° C. with an embossing roll (embossing area percentage: 7%, roll diameter: 150 mm, boss pitches: 2.1 mm transversely and longitudinally, boss shape: rhombus). Thus, a spunbonded nonwoven fabric with a basis weight of 100 g/m$^2$ was obtained.

(2) Touch Evaluation for Unstretched Nonwoven Fabric

The above spunbonded nonwoven fabric was evaluated for its touch by 10 panelists. The evaluation was made based on the following criteria:

A: 10 out of the 10 panelists said the fabric was nonsticky and nice to the touch.

B: 9 to 7 out of the 10 panelists said the fabric was nonsticky and nice to the touch.

C: 6 to 3 out of the 10 panelists said the fabric was nonsticky and nice to the touch.

D: 2 or 0 out of the 10 panelists said the fabric was nonsticky and nice to the touch.

(3) Stretching

Five specimens, each 5.0 cm in the machine direction (MD) and 2.5 cm in the cross direction (CD), were cut from the spunbonded nonwoven fabric prepared in (1). They were each stretched at a gap between chucks of 30 mm and a rate of 30 mm/min Immediately after 100% elongation, each specimen was relaxed to its original length at the same rate, thereby obtaining an elastic nonwoven fabric. The strain of each elastic nonwoven fabric was measured at a tensile load of 0 gf, and the strains of the 5 specimens were averaged to determine the residual strain (%).

(4) Evaluation of Elastic Nonwoven Fabrics

The elastic nonwoven fabric obtained in (3) was evaluated for its touch based on the criteria described in (2).

Separately, the elastic nonwoven fabrics given after the measurement of the residual strain in (3) were each subsequently stretched to 100% elongation under the same conditions as in (3), thereat measuring the load. The values of the 5 specimens were averaged, and the average was divided by the basis weight to determine the tensile strength (gf/basis weight).

(5) Measurement of Average Smallest Fiber Diameter

Without discharging the thermoplastic polymer B-1, TPU-1 alone was melt spun under the same manner as in (1). In the spinning, the drawing rate for the filaments was stepwise increased by 250 m/min until filament breakage took place and lowered therefrom by 250 m/min. At the drawing rate determined as described above, the fibers were drawn and deposited to form a web. This web was defined as a web having smallest fiber diameters. The image of web having smallest fiber diameters was taken at 200-hold magnification, and was analyzed on a dimension measuring software Pixs 2000 Ver 2.0 (Inotech). Diameters were measured for arbitrary 100 fibers and averaged to determine the average smallest fiber diameter (μm) of the fibers of TPU-1.

All the results are set forth in Table 1.

Example 2

Elastic nonwoven fabrics were produced and evaluated by the procedure illustrated in Example 1 except that TPU-1 was replaced by TPU-2. The results are set forth in Table 1.

An average smallest fiber diameter (μm) of the fibers of TPU-2 was determined by the procedure illustrated in Example 1 except that TPU-1 was replaced by TPU-2. The results are set forth in Table 1.

Example 3

Elastic nonwoven fabrics were produced and evaluated by the procedure illustrated in Example 1 except that TPU-1 was replaced by TPU-4 and the thermoplastic polymer B-1 by a medium-density polyethylene (hereinafter "MDPE") that had MFR (ASTM D1238, 190° C., 2.16 kg load) of 30 g/10 min, a density of 0.95 g/cm$^3$ and a melting point of 125° C. The results are set forth in Table 1.

An average smallest fiber diameter (μm) of the fibers of TPU-4 was determined by the procedure illustrated in Example 1 except that TPU-1 was replaced by TPU-4. The results are set forth in Table 1.

Comparative Example 1

A thermoplastic polyurethane elastomer (trade name: Elastollan 1180A-10 (BASF Japan Ltd.)) had a starting temperature for solidifying of 78.4° C. and a hardness of 82 A, and contained $3.20\times10^6$ polar-solvent-insoluble particles per g. This polyurethane elastomer was maintained at 100° C. over a period of 8 hours to a water content of 115 ppm.

Elastollan 1180A-10 and a linear low-density polyethylene (hereinafter "LLDPE") (trade name: Exact 3017 (Exxon))

were melt spun on a spunbond machine (length in a cross direction of collecting surface: 100 mm) to form concentric sheath-core conjugate fibers in which the core consisted of Elastollan 1180A-10 and the sheath of LLDPE with a weight ratio of 85/15 (core/sheath). The fibers thus produced were deposited on a belt. The above spinning was performed at a die temperature of 220° C. and an output rate of 1.0 g/min per nozzle.

Subsequently, the web on the belt tried to be embossed at 80° C. with an embossing roll (embossing area percentage: 7%, roll diameter: 150 mm, boss pitches: 2.1 mm transversely and longitudinally, boss shape: rhombus) to obtain a spunbonded nonwoven fabric with a basis weight of 100 g/m$^2$.

However, the spunbonded nonwoven fabric obtained above was in fact of inferior quality since the fibers had been frequently broken in the spinning tower when the fibers of 50 μm or less in diameter were produced. Accordingly, some evaluations were avoided. The results are set forth in Table 1.

An average smallest fiber diameter (μm) of the above concentric sheath-core conjugate fibers was determined by the procedure illustrated in Example 1 instead of the fibers of TPU-1. The results are set forth in Table 1.

Comparative Example 2

A spunbonded nonwoven fabric was produced by the procedure illustrated in Comparative Example 1 except that the core was formed of TPU-1 in place of Elastollan 1180A-10 and the sheath was made of PP-1 instead of LLDPE, and that the core-sheath weight ratio was altered to 50/50. The spunbonded nonwoven fabric was evaluated for its touch as described in Example 1.

Thereafter, the spunbonded nonwoven fabric was stretched by the same method as in Example 1 to attain elasticity. The resultant elastic nonwoven fabrics were evaluated by the methods described in Example 1. The results are set forth in Table 1. The nonwoven fabrics had a large residual strain, indicating poor elastic properties.

An average smallest fiber diameter (μm) of the concentric sheath-core conjugate fibers was determined by the procedure illustrated in Comparative Example 1 except that the core was formed of TPU-1 in place of Elastollan 1180A-10 and the sheath was made of PP-1 instead of LLDPE, and that the core-sheath weight ratio was altered to 50/50. The results are set forth in Table 1.

Comparative Example 3

Elastic nonwoven fabrics were produced by the procedure illustrate in Comparative Example 2 except that the melt spinning for TPU-1 and PP-1 in 50/50 weight ratio was carried out using a hollow, eight-segmented spinneret; that is, the fibers were not in concentric sheath-core configuration but in hollow, octamerous configuration.

The resultant elastic nonwoven fabrics were evaluated by the methods described in Example 1. The results are set forth in Table 1. The nonwoven fabrics had a large residual strain, indicating poor elastic properties.

An average smallest fiber diameter (μm) of the eight-segmented conjugate fibers was determined by the procedure illustrated in Comparative Example 2 except that the melt spinning for TPU-1 and PP-1 in 50/50 weight ratio was carried out using a hollow, eight-segmented spinneret. The results are set forth in Table 1.

Comparative Example 4

A thermoplastic polyurethane elastomer (trade name: Elastollan XET-275-10MS (BASF Japan Ltd.)) had a starting temperature for solidifying of 60.2° C. and a hardness of 75 A, and contained 1.40×10$^6$ polar-solvent-insoluble particles per g. This polyurethane elastomer was maintained in a dryer at 100° C. over a period of 8 hours to a water content of 89 ppm.

Elastic nonwoven fabrics were produced by the procedure illustrated in Example 1 except that TPU-1 was replaced by Elastollan XET-275-10MS. In this case, the production suffered bad spinnability with many fibers adhering to the spinning tower wall.

The resultant elastic nonwoven fabrics were evaluated by the methods described in Example 1. The results are set forth in Table 1. The nonwoven fabrics had a bad touch.

An average smallest fiber diameter (m) of the fibers of Elastollan XET-275-10MS was determined by the procedure illustrated in Example 1 except that TPU-1 was replaced by Elastollan XET-275-10MS. The results are set forth in Table 1.

TABLE 1

| | Example 1 | | Example 2 | | Example 3 | |
|---|---|---|---|---|---|---|
| Fiber configuration | Fiber mixture | | Fiber mixture | | Fiber mixture | |
| | Fiber A | Fiber B | Fiber A | Fiber B | Fiber A | Fiber B |
| Weight Ratio (%) | 42 | 58 | 42 | 58 | 42 | 58 |
| Polymer (wt %) | TPU-1 | PP-1 | TPU-2 | PP-1 | TPU-4 | MDPE |
| | (100) | (96) | (100) | (96) | (100) | (100) |
| | — | HDPE | — | HDPE | — | — |
| | | (4) | | (4) | | |
| Starting temperature for solidifying of TPU | 115.6° C. | | 106.8° C. | | 103.7° C. | |
| Polar-solvent-insoluble particles in TPU | 1.40 × 10$^6$/g | | 1.50 × 10$^6$/g | | 1.50 × 10$^6$/g | |
| Shore A hardness of TPU | 86 | | 85 | | 86 | |
| Forming method | Spunbonding | | Spunbonding | | Spunbonding- | |
| Fusion bonding method | Thermal embossing | | Thermal embossing | | Thermal embossing | |
| Basis weight | 100 g/m$^2$ | | 100 g/m$^2$ | | 100 g/m$^2$ | |
| Average smallest fiber diameter (μm) | 25.8 | | 28.0 | | 25.8 | |
| Occurrence of filament breakage (times/5 min) | 0 | | 0 | | 0 | |
| Occurrence of fusion bonded fibers (times/5 min) | 0 | | 0 | | 0 | |
| Touch of unstretched fabric | B | | B | | B | |
| Tensile strength (gf/basis weight) | 2.5 | | 2.5 | | 6.0 | |
| Residual strain (%) | 25 | | 25 | | 30 | |
| Touch of stretched fabric | A | | A | | A | |

TABLE 1-continued

| | Comparative Example 1 | | Comparative Example 2 | |
|---|---|---|---|---|
| Fiber Configuration | Concentric sheath-core conjugate fiber | | Concentric sheath-core conjugate fiber | |
| | Core | Sheath | Core | Sheath |
| Weight ratio (%) | 85 | 15 | 50 | 50 |
| Polymer (wt %) | 1180A-10 (100) — | LLDPE (100) — | TPU-1 (100) — | PP-1 (100) — |
| Starting temperature for solidifying of TPU | 78.4° C. | | 115.6° C. | |
| Polar-solvent-insoluble particles in TPU | $3.20 \times 10^6$/g | | $1.40 \times 10^6$/g | |
| Shore A hardness of TPU | 82 | | 86 | |
| Forming method | Spunbonding | | Spunbonding | |
| Fusion bonding method | Thermal embossing | | Thermal embossing | |
| Basis weight | 100 g/m$^2$ | | 100 g/m$^2$ | |
| Average smallest fiber diameter (μm) | 52.0 | | 24.3 | |
| Occurrence of filament breakage (times/5 min) | 10 | | 0 | |
| Occurrence of fusion bonded fibers (times/5 min) | 0 | | 0 | |
| Touch of unstretched fabric | Evaluation avoided | | B | |
| Tensile strength (gf/basis weight) | Evaluation avoided | | 0.3 | |
| Residual strain (%) | Evaluation avoided | | 83 | |
| Touch of stretched fabric | Evaluation avoided | | B | |

| | Comparative Example 3 | | Comparative Example 4 | |
|---|---|---|---|---|
| Fiber configuration | Eight-segmented conjugate fiber | | Fiber mixture | |
| | Component 1 | Component 2 | Fiber A | Fiber B |
| Weight ratio (%) | 50 | 50 | 42 | 58 |
| Polymer (wt %) | TPU-1 (100) — | PP-1 (100) — | XET-275-10MS (100) — | PP-1 (96) HDPE (4) |
| Starting temperature for solidifying of TPU | 115.6° C. | | 60.2° C. | |
| Polar-solvent-insoluble particles in TPU | $1.40 \times 10^6$/g | | $1.40 \times 10^6$/g | |
| Shore A hardness of TPU | 86 | | 75 | |
| Forming method | Spunbonding | | Spunbonding | |
| Fusion bonding method | Thermal embossing | | Thermal embossing | |
| Basis weight | 100 g/m$^2$ | | 100 g/m$^2$ | |
| Average smallest fiber diameter (μm) | 32.0 | | 45.0 | |
| Occurrence of filament breakage (times/5 min) | 0 | | 0 | |
| Occurrence of fusion bonded fibers (times/5 min) | 0 | | 12 | |
| Touch of unstretched fabric | C | | C | |
| Tensile strength (gf/basiss weight) | 1.3 | | 1.5 | |
| Residual strain (%) | 52 | | 23 | |
| Touch of stretched fabric | B | | B | |

Example 4

(1) Preparation of Spunbonded Nonwoven Fabric

The spinning procedure described in Example 1 was repeated except that TPU-1 was replaced by TPU-4, the extruders (30 mm in diameter) were changed to other types (50 mm in diameter), and a spunbond machine (length in a cross direction of collecting surface: 800 mm) replaced the spunbond machine (length in a cross direction of collecting surface: 100 mm). The resultant fiber mixture in which the fibers A comprised TPU-4 and the fibers B comprised the thermoplastic polymer B-1, was deposited on a collecting surface, forming a web.

Thereafter, the web was embossed in the same manner as in Example 1 except that the embossing temperature was 120° C., the embossing area percentage was 18%, the embossing roll diameter was 400 mm, and the basis weight was 70 g/m$^2$, to produce a spunbonded nonwoven fabric.

(2) Stretching

Five specimens, each 15.0 cm in the machine direction (MD) and 5.0 cm in the cross direction (CD), were cut from the spunbonded nonwoven fabric prepared in (1). They were each stretched at a gap between chucks of 100 mm and a rate of 100 mm/min. Immediately after 200% elongation, each specimen was relaxed to its original length at the same rate, thereby obtaining an elastic nonwoven fabric.

(3) Evaluation of Elastic Nonwoven Fabrics

The elastic nonwoven fabrics obtained in (2) were evaluated for the touch based on the criteria described in Example 1.

Separately, the elastic nonwoven fabrics given after the stretching in (2) were each released to eliminate their deflection due to the residual strain from the stretching. They were each stretched again to 100% elongation at a gap between chucks of 100 mm and a rate of 100 mm/min, thereat measuring the load. Immediately thereafter, each specimen was relaxed to its original length at the same rate. The strain of each elastic nonwoven fabric was measured at a tensile load of 0 gf. The loads at 100% elongation of the 5 specimens were averaged, and the average was divided by the basis weight to determine the tensile strength (gf/basis weight). The residual strain (%) was determined by averaging the strains of the 5 specimens.

(4) Measurement of Average Smallest Fiber Diameter

The average smallest fiber diameter of the fibers of TPU-4 was determined by the method described in Example 1.

All the results are set forth in Table 2.

Example 5

Elastic nonwoven fabrics were produced and evaluated by the procedure illustrated in Example 4 except that the basis weight was changed to 137 g/m$^2$. The results are set forth in Table 2.

An average smallest fiber diameter (μm) of the fibers of TPU-4 was determined by the procedure illustrated in Example 1.

Example 6

Elastic nonwoven fabrics were produced and evaluated by the procedure illustrated in Example 4 except that the output rate for the fiber B was changed to 0.90 g/min per nozzle, the fiber A and the fiber B had a weight ratio of 27/73 (A/B), and the basis weight was altered to 104 g/m$^2$. The results are set forth in Table 2.

An average smallest fiber diameter (μm) of the fibers of TPU-4 was determined by the procedure illustrated in Example 4.

they were deposited on a collecting surface to form a web of fiber mixture. Separately, a propylene homopolymer (hereinafter "PP-2") that had MFR (ASTM D1238, 230° C., 2.16 kg load) of 15 g/10 min, a density of 0.91 g/cm$^2$ and a melting point of 160° C., and PP-1 were melt spun by spunbonding technique to form a concentric sheath-core conjugate fiber in which the core consisted of PP-2 and the sheath consisted of PP-1 with a weight ratio of 10/90 (core/sheath). The concentric conjugate fiber was deposited on the fiber mixture web.

The resultant two-layer deposit was embossed at 120° C. with an embossing roll (embossing area percentage: 7%, roll diameter: 150 mm, boss pitches: 2.1 mm transversely and longitudinally, boss shape: rhombus). Thus, a spunbonded nonwoven fabric laminate with a basis weight of 140 g/m$^2$ was obtained.

TABLE 2

| | Example 4 | | Example 5 | | Example 6 | |
|---|---|---|---|---|---|---|
| Fiber configuration | Fiber mixture | | Fiber mixture | | Fiber mixture | |
| | Fiber A | Fiber B | Fiber A | Fiber B | Fiber A | Fiber B |
| Weight ratio (%) | 43 | 57 | 43 | 57 | 27 | 73 |
| Polymer (wt %) | TPU-4 | PP-1 | TPU-4 | PP-1 | TPU-4 | PP-1 |
| | (100) | (96) | (100) | (96) | (100) | (96) |
| | HD | PE | HD | PE | HD | PE |
| | — | (4) | — | (4) | — | (4) |
| Starting temperature for solidifying of TPU | 103.7° C. | | 103.7° C. | | 103.7° C. | |
| Polar-solvent-insoluble particles in TPU | 1.50 × 106/g | | 1.50 × 10$^6$/g | | 1.50 × 10$^6$/g | |
| Shore A hardness of TPU | 86 | | 86 | | 86 | |
| Forming method | Spunbonding | | Spunbonding | | Spunbonding | |
| Fusion bonding method | Thermal embossing | | Thermal embossing | | Thermal embossing | |
| Basis weight | 70 g/m$^2$ | | 137 g/m$^2$ | | 104 g/m$^2$ | |
| Average smallest fiber diameter (μm) | 26 | | 26 | | 26 | |
| Occurrence of filament breakage (times/5 min) | 0 | | 0 | | 0 | |
| Occurrence of fusion bonded fibers (times/5 min) | 0 | | 0 | | 0 | |
| Tensile strength (gf/basis weight) | 21 | | 15 | | 63 | |
| Residual strain (%) | 16 | | 18 | | 30 | |
| Touch of stretched fabric | A | | A | | A | |

Example 7

An elastic nonwoven fabric with 5.0 cm in the machine direction (MD) and 2.5 cm in the cross direction (CD) was produced by means of the same spunbond machine as in Example 4 except that TPU-1 was replaced by TPU-4, the basis weight was changed to 60 g/m$^2$ and the draw ratio was 150%.

The elastic nonwoven fabric stretched to 50% elongation at a gap between chucks of 30 mm and a rate of 30 ram/min, and held for 120 min at 50% elongation and 40° C.

The stress retention was 56.5% at an elongation of 50% and a holding time of 120 min.

Comparative Example 5

An elastic nonwoven fabric was produced and tested to determine its stress retention by the procedure illustrated in Example 7 except that TPU-4 was replaced by a styrene elastomer SEBS (styrene/(ethylene-butylene)/styrene block copolymer). The stress retention was 32.7% at an elongation of 50% and a holding time of 120 min.

Example 8

(1) Preparation of Nonwoven Fabric Laminate

TPU-1 and the thermoplastic polymer B-1 were spun into fibers A and B respectively as described in Example 1, and (2) Touch Evaluation for Unstretched Nonwoven Fabric Laminate The nonwoven fabric laminate was evaluated for its touch based on the following criteria described in Example 1.

(3) Stretching

Five specimens, each 5.0 cm in the machine direction (MD) and 2.5 cm in the cross direction (CD), were cut from the nonwoven fabric laminate prepared in (1). They were each stretched at a gap between chucks of 30 mm and a rate of 30 mm/min. Immediately after 100% elongation, each specimen was relaxed to its original length at the same rate, thereby obtaining a laminate including an elastic nonwoven fabric. The strain of each laminate was measured at a tensile load of 0 gf and the strains of the 5 specimens were averaged to determine the residual strain (%).

(4) Evaluation of Laminate

The nonwoven fabric laminates obtained in (3) were evaluated for the touch based on the criteria described in Example 1.

Separately, the laminates given after the measurement of the residual strain in (3) were each subsequently stretched to 100% elongation under the same conditions as in (3), thereat measuring the load. The values of the 5 specimens were averaged, and the average was divided by the basis weight to determine the tensile strength (gf/basis weight).

Further, a 25-mm wide strip specimen was cut out from one laminate produced in (3). The specimen was torn between the nonwoven fabric layers to some length in the longer direction from one end of the laminate. Subsequently, the specimen was fixed in a jig of a tester Model 2005 (Isotesco), with the torn ends being held at a gap between chucks of 50 mm so as to form a T shape (180° C. peeling). Then a peeling test was conducted at 23° C., 50% RH and a peel rate of 100 mm/min to determine the interlaminar bond strength (g/25 mm).

All the results are set forth in Table 3.

Comparative Example 6

A laminate was produced and evaluated by the methods described in Example 8 except that TPU-1 alone was melt spun to form a web made of monocomponent fibers. The results are set forth in Table 3. The laminate displayed a weak interlaminar bonding strength, far below a level required for elastic components.

TABLE 3

| | | Example 8 | | Comparative Example 6 | |
|---|---|---|---|---|---|
| First layer | Fiber configuration | Fiber mixture | | Single fiber web | |
| | | Fiber A | Fiber B | — | |
| | Weight ratio (%) | 42 | 58 | 100 | |
| | Polymer (wt %) | TPU-1 (100) | PP-1 (96) | TPU-1 (100) | |
| | | — | HDPE (4) | — | |
| Second layer | Fiber configuration | Concentric sheath-core conjugate Fiber | | Concentric sheath-core conjugate Fiber | |
| | | Core | Sheath | Core | Sheath |
| | Weight ratio (%) | 10 | 90 | 10 | 90 |
| | Polymer (wt %) | PP-2 (100) | PP-1 (100) | PP-2 (100) | PP-1 (100) |
| Touch of unstretched fabric | | A | | A | |
| Bond strength (g/25 mm) | | 70.0 | | 20.0 | |
| Tensile strength (gf/basis weight) | | 2.6 | | 2.6 | |
| Residual strain (%) | | 25 | | 19 | |
| Touch of stretched fabric | | A | | A | |

INDUSTRIAL APPLICABILITY

The elastic nonwoven fabric according to the invention is excellent in productivity, touch and heat sealing properties, and has low residual strain and high elasticity. Therefore, it can be suitably used in hygiene materials, industrial materials, garments and materials for sporting goods.

What is claimed is:

1. A spunbonded elastic nonwoven fabric obtained by depositing a fiber mixture into the form of a web, wherein the fiber mixture comprises fibers A comprising a polymer A containing a thermoplastic polyurethane elastomer and fibers B comprising a thermoplastic polymer B other than the thermoplastic polyurethane elastomer, said thermoplastic polyurethane elastomer having a starting temperature for solidifying of 65° C. or above as measured by a differential scanning calorimeter (DSC) and containing $3.00\times10^6$ or less polar-solvent-insoluble particles per gram as counted on a particle size distribution analyzer, which is based on an electrical sensing zone method, equipped with an aperture tube having an orifice of 100 μm in diameter.

2. The spunbonded elastic nonwoven fabric according to claim 1, wherein the fiber B is an inelastic fiber.

3. The spunbonded elastic nonwoven fabric according to claim 1, wherein the polymer A contains the thermoplastic polyurethane elastomer in an amount of 50 wt % or more.

4. The spunbonded elastic nonwoven fabric according to claim 1, wherein on the thermoplastic polyurethane elastomer, a total heat of fusion (a) determined from endothermic peaks within the temperature range of from 90 to 140° C. and a total heat of fusion (b) determined from endothermic peaks within the temperature range of from above 140 to 220° C., which are measured by a differential scanning calorimeter (DSC), satisfy the following relation (1):

$$a/(a+b)\times100\leqq80 \quad (1).$$

5. A laminate comprising at least one layer comprising the spunbonded elastic nonwoven fabric of claim 1.

6. A hygiene material comprising the spunbonded elastic nonwoven fabric of claim 1.

7. A production method for spunbonded elastic nonwoven fabrics, said method comprising the steps of:

(I) separately melting a polymer A containing a thermoplastic polyurethane elastomer and a thermoplastic polymer B other than the thermoplastic polyurethane elastomer, said thermoplastic polyurethane elastomer having a starting temperature for solidifying of 65° C. or above as measured by a differential scanning calorimeter (DSC) and containing $3.00\times10^6$ or less polar-solvent-insoluble particles per gram as counted on a particle size distribution analyzer, which is based on an electrical sensing zone method, equipped with an aperture tube having an orifice of 100 μm in diameter;

(II) extruding the polymer A and the polymer B simultaneously through a die having respective nozzles for the polymers to spin them and depositing fibers into the form of a web of fiber mixture;

(III) partially fusion bonding the web; and (IV) stretching the partially fusion bonded web, wherein the thermoplastic polyurethane elastomer used in the act (I) is produced by a production process comprising:

a step (A); an isocyanate compound, a polyol and a chain extender are mixed and stirred in advance, a step (B); the mixture is fed to a static mixer or discharged on a belt to be heated to induce polymerization, and a step (C); filtering the reaction product of the mixture after polymerization.

8. A spunbonded elastic nonwoven fabric obtained by depositing a fiber mixture into the form of a web, partially fusion bonding the deposit and stretching the partially fusion bonded web, wherein the fiber mixture has an average fiber diameter of 30 μm or less and comprises fibers A comprising a polymer A containing a thermoplastic polyurethane elastomer and fibers B comprising a thermoplastic polymer B other than the thermoplastic polyurethane elastomer, said thermoplastic polyurethane elastomer having a starting temperature for solidifying of 65° C. or above as measured by a differential scanning calorimeter (DSC) and containing $3.00\times10^6$ or less polar-solvent-insoluble particles per gram as counted on a particle size distribution analyzer, which is based on an electrical sensing zone method, equipped with an aperture tube having an orifice of 100 μm in diameter.

9. The spunbonded elastic nonwoven fabric according to claim 8, wherein the fiber B is an inelastic fiber.

10. The spunbonded elastic nonwoven fabric according to claim 8, wherein the polymer A contains the thermoplastic polyurethane elastomer in an amount of 50 wt % or more.

11. The spunbonded elastic nonwoven fabric according to claim 8, wherein on the thermoplastic polyurethane elastomer, a total heat of fusion (a) determined from endothermic peaks within the temperature range of from 90 to 140° C. and a total heat of fusion (b) determined from endothermic peaks within the temperature range of from above 140 to 220° C., which are measured by a differential scanning calorimeter (DSC), satisfy the following relation (1):

$$a/(a+b)\times 100 \leqq 80 \quad (1).$$

12. A laminate comprising at least one layer comprising the elastic nonwoven fabric of claim 8.

13. A hygiene material comprising the spunbonded elastic nonwoven fabric of claim 8.

14. The production method of claim 7, wherein the step (C) is a filtering step using a metal mesh or a polymer filter.

15. The spunbonded elastic nonwoven fabric according to claim 1, wherein the elastic nonwoven fabric is obtained by the production method of claim 7.

16. The elastic nonwoven fabric according to claim 1, wherein said elastic nonwoven fabric is obtained by partially fusion bonding the deposit and stretching the partially fusion bonded web.

17. The elastic nonwoven fabric according to claim 1, wherein the fiber mixture has a fiber diameter of 30 μm or less.

18. The elastic nonwoven fabric according to claim 1, wherein said elastic nonwoven fabric is obtained by partially fusion bonding the deposit and stretching the partially fusion bonded web, wherein the fiber mixture has a fiber diameter of 30 μm or less.

19. The elastic nonwoven fabric according to claim 1, wherein the fiber B comprises at least one resin selected from a group of a resin containing polyethylene, a resin containing polypropylene, and a resin containing polyethylene and polypropylene.

20. The elastic nonwoven fabric according to claim 1, wherein the fiber B comprises at least one resin selected from a group of polyethylene and polypropylene.

21. The spunbonded elastic nonwoven fabric according to claim 1, wherein the thermoplastic polyurethane elastomer ranges in melt viscosity from 100 to 3,000 Pas as measured at 200° C. and 100 $sec^{-1}$ shear rate.

22. The production method for spunbonded elastic nonwoven fabrics according to claim 7, wherein the thermoplastic polyurethane elastomer ranges in melt viscosity from 100 to 3,000 Pa·s as measured at 200° C. and 100 $sec^{-1}$ shear rate.

23. The spunbonded elastic nonwoven fabric according to claim 8, wherein the thermoplastic polyurethane elastomer ranges in melt viscosity from 100 to 3,000 Pa·s as measured at 200° C. and 100 $sec^{-1}$ shear rate.

* * * * *